US011672362B1

(12) United States Patent
Kennedy

(10) Patent No.: US 11,672,362 B1
(45) Date of Patent: Jun. 13, 2023

(54) WALL MOUNTED RACK APPARATUS

(71) Applicant: Hugh Jason Kennedy, Delta (CA)

(72) Inventor: Hugh Jason Kennedy, Delta (CA)

( * ) Notice: Subject to any disclaimer, the term of this patent is extended or adjusted under 35 U.S.C. 154(b) by 0 days.

(21) Appl. No.: 17/647,678

(22) Filed: Jan. 11, 2022

(51) Int. Cl.

| | |
|---|---|
| ***A47F 5/08*** | (2006.01) |
| ***A47B 96/06*** | (2006.01) |
| *A47B 57/04* | (2006.01) |
| *A47B 57/46* | (2006.01) |
| *A47B 57/42* | (2006.01) |

(52) U.S. Cl.
CPC ..... *A47F 5/0853* (2013.01); *A47B 96/061* (2013.01); *A47B 96/067* (2013.01); *A47B 57/045* (2013.01); *A47B 57/42* (2013.01); *A47B 57/46* (2013.01)

(58) Field of Classification Search
CPC ..... A47B 96/061; A47B 96/067; A47B 96/00; A47B 57/00; A47B 57/045; A47B 57/42; A47B 57/46; A47B 57/52; A47B 57/56; A47F 5/0853
See application file for complete search history.

(56) References Cited

U.S. PATENT DOCUMENTS 961,018 A * 6/1910 Robb ..... A47B 96/061 248/214
1,090,687 A * 3/1914 Coon ..... A47B 57/045 248/242
2,833,503 A * 5/1958 Harshbarger ..... E04G 5/06 182/113
2,997,268 A * 8/1961 Dimmitt ..... E04G 3/18 248/235
3,698,680 A * 10/1972 Shoemaker ..... E04G 17/002 249/189
4,753,405 A * 6/1988 Camilleri ..... A47B 96/061 108/134
4,804,159 A * 2/1989 Martel ..... A47B 96/061 108/106
5,388,663 A * 2/1995 Phillippe ..... E04G 17/002 248/246
7,347,404 B2 * 3/2008 Anzai ..... A47F 5/0853 248/250
7,900,783 B2 * 3/2011 Fernandez ..... F16B 25/0057 211/90.03
8,146,873 B2 * 4/2012 Johnson ..... A47B 96/061 248/242

(Continued)

*Primary Examiner* — Devin K Barnett
(74) *Attorney, Agent, or Firm* — Orin Del Vecchio

(57) ABSTRACT

A wall mounted rack apparatus that is configured to provide distribution of gravitational forces so as to enable accommodation of larger weight to be suspended therefrom. The wall mounted rack apparatus includes a cantilever member that is secured to a first wall plate member and extends outward from a wall and is perpendicular thereto. A cantilever support member is present beneath the cantilever member wherein a first end is operably coupled to the wall and the second end is configured to releasably secure to a portion of the cantilever member providing support thereof. A rear support member is operably coupled to the cantilever support member and extends upward therefrom. The rear support member includes a second end wherein the second end is configured to surroundably secure to a portion of the cantilever member. The angular configuration of the cantilever support member and rear support member provide distribution of gravitational forces.

8 Claims, 2 Drawing Sheets

(56) References Cited

U.S. PATENT DOCUMENTS

| | | | | |
|---|---|---|---|---|
| 10,561,242 | B1 * | 2/2020 | Ignacio | A47B 57/04 |
| 2018/0035801 | A1 * | 2/2018 | Kunsch | A47B 96/07 |
| 2019/0239646 | A1 * | 8/2019 | Newman | A47B 96/028 |

* cited by examiner

WALL MOUNTED RACK APPARATUS

FIELD OF THE INVENTION

The present invention relates generally to suspension elements, more specifically but not by way of limitation, an apparatus configured to provide suspension of at least one element adjacent a vertical wall wherein the present invention provides a support member arrangement that promotes successful suspension of larger objects on a cantilever member thereof.

BACKGROUND

It is common both in commercial environments as well as residential environments to mount various objects to the vertical walls that are present within a facility or structure. Whether for aesthetic purposes or for storage there are numerous types of mounting apparatus that function to facilitate mounting an object adjacent to a vertical wall. Additionally, items such as but not limited to shelving are also mounted to vertical walls utilizing various existing fasteners. Fasteners such as but not limited to hangers and hollow wall anchors are some of the many existing elements that are utilized to secure the aforementioned apparatus to vertical walls.

One issue with existing apparatus is their inability to secure higher weight objects due to the intrinsic deficiencies in the design thereof. As racks or other objects are secured to walls gravitational force exerts a downward force thereon at a point that is distally located from the wall. This force is transferred to the mount securing the apparatus to the wall and ultimately results in the failure of the mounting apparatus which causes either the object to fall or the mounting apparatus itself to become dislodged from the wall resulting in damage to both the object as well as the wall. The inability to provide transfer of force across conventional mounting apparatus creates issues when the desire is to suspend an object that will have a greater weight on a vertical wall wherein the object is located adjacent but outward from the wall.

Accordingly, there is a need for a wall mounted rack apparatus that is configured to be secured to a vertical wall and provide distribution of gravitational forces in order to ensure the maintenance of the position of the object proximate the vertical wall and as such reduce the probability of damage to both the wall and the object.

SUMMARY OF THE INVENTION

It is the object of the present invention to provide a wall mounted rack apparatus that is configured to provide distribution of gravitational forces in order to facilitate suspension of larger objects wherein the present invention includes a first wall plate member and a second wall plate member.

Another object of the present invention is to provide an apparatus operable to facilitate the suspension of an object adjacent to a vertical wall wherein the first wall plate member and second wall plate member are secured to an outer surface of a vertical wall.

A further object of the present invention is to provide a wall mounted rack apparatus that is configured to provide distribution of gravitational forces in order to facilitate suspension of larger objects wherein the apparatus of the invention includes at least one cantilever support member.

Still another object of the present invention is to provide an apparatus operable to facilitate the suspension of an object adjacent to a vertical wall wherein the cantilever support member includes a first end and a second end wherein the first end is secured to the first wall plate member.

An additional object of the present invention is to provide a wall mounted rack apparatus that is configured to provide distribution of gravitational forces in order to facilitate suspension of larger objects that further includes a cantilever member wherein the cantilever member includes a first end and second end.

Yet a further object of the present invention is to provide an apparatus operable to facilitate the suspension of an object adjacent to a vertical wall wherein the present invention further includes rear support member wherein the rear support member is configured to be operably coupled to the cantilever support member and the cantilever member.

Another object of the present invention is to provide a wall mounted rack apparatus that is configured to provide distribution of gravitational forces in order to facilitate suspension of larger objects wherein the rear support member includes a second end that is configured to at least partially surround a portion of the cantilever member.

Still another object of the present invention is to provide an apparatus operable to facilitate the suspension of an object adjacent to a vertical wall wherein the second end of the cantilever support member is configured in some embodiments of the present invention to either cradle or surroundably mount the cantilever member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
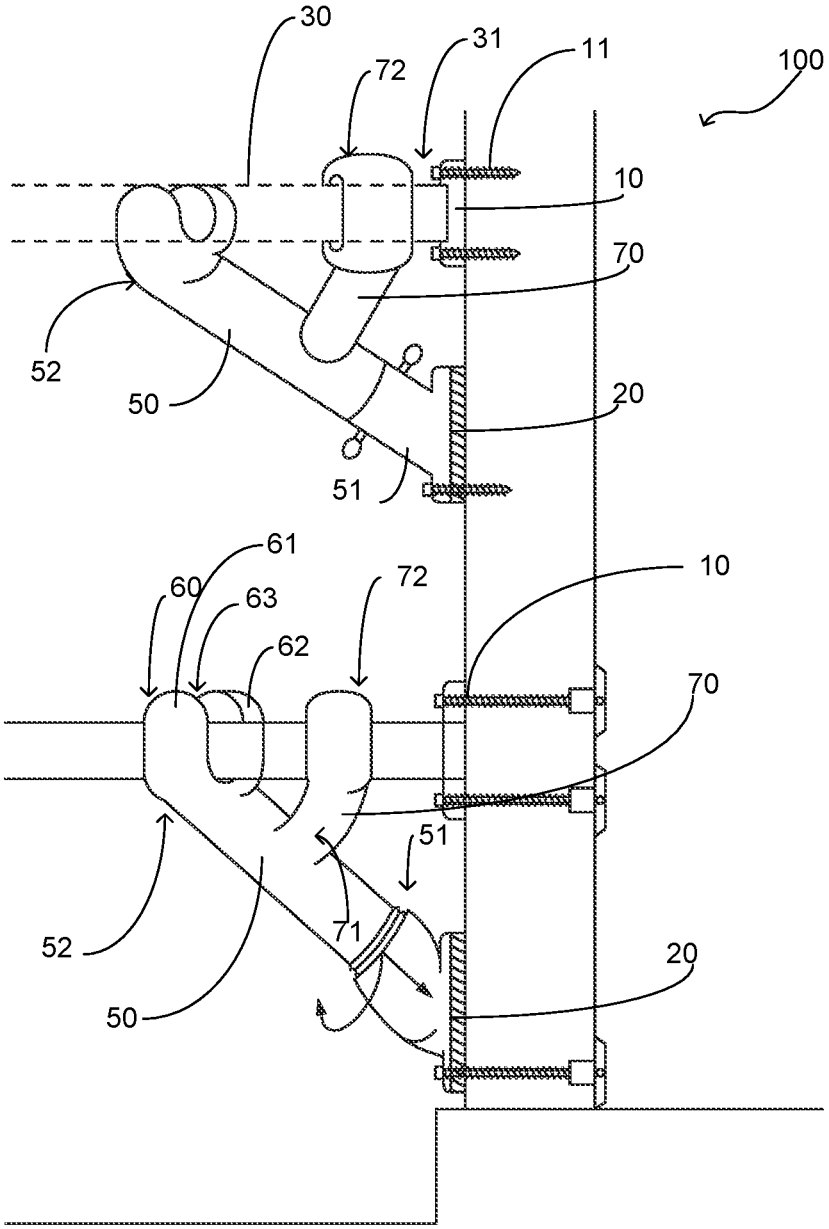
FIG. 1 is a side perspective view of a first embodiment of the present invention.

Referring now to the drawings submitted herewith, wherein various elements depicted therein are not necessarily drawn to scale and wherein through the views and figures like elements are referenced with identical reference numerals, there is illustrated a wall mounted rack apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring now to the Figures submitted as a part hereof, the wall mounted rack apparatus 100 is designed to transfer gravitational force acting on a mass support at an area distal to the wall 99 so as to improve the ability for the wall mounted rack apparatus 100 to secure and retain heavier objects for a longer period of time and further avoid damage to the wall 99. Discussed herein are two embodiments of the wall mounted rack apparatus 100 and it should be understood within the scope of the present invention that the elements of the embodiments could employ alternate types of fastening techniques so as to operably couple either releasably or permanently. Furthermore, it should be understood within the scope of the present invention that elements of the wall mounted rack apparatus 100 could employ conventional techniques such as but not limited to telescoping, pivoting or other techniques so as to provide arrangement and re-configuration thereof.

The wall mounted rack apparatus 100 includes a first wall plate member 10 and a second wall plate member 20. The first wall plate member 10 is manufactured from a durable material such as but not limited to metal. The first wall plate member 10 is planar in manner and it should be understood within the scope of the present invention that the first wall plate member 10 could be provided in alternate sizes. The first wall plate member 10 is secured to wall 99 utilizing fasteners 11 such as but not limited to screws. It should be understood within the scope of the present invention that the fasteners 11 could be alternate suitable types of conventional fasteners.

The first wall plate member 10 is operably coupled to the first end 31 of the cantilever support member 30. The cantilever support member 30 is manufactured from a lightweight rigid material such as but not limited to metal tubing. The cantilever support member 30 includes first end 31 and second end 32 wherein second 32 is distal to wall 99. It should be understood within the scope of the present invention that the cantilever support member 30 could be provided in alternate lengths and diameters. It should further be understood within the scope of the present invention that the cantilever support member 30 could be configured on the second end 32 thereof in numerous alternate manners in order to releasably secure or coupled to an object or item to be supported. By way of example but not limitation the second end 32 of the cantilever support member 30 could be configured to operably couple to a shelf unit or have a hook or other similar element present thereon. The cantilever member 30 is positioned in a manner to be generally perpendicular to the wall 99 and extending outward therefrom.

The wall mounted rack apparatus 100 further includes a cantilever support member 50. The cantilever support member 50 includes a first end 51 and second end 52. The cantilever support member 50 is manufactured from a suitable lightweight rigid material such as but not limited to metal. The cantilever support member 50 is positioned in an angular manner with respect to the wall 99 and the cantilever member 30. The cantilever support member 50 is oriented in the manner discussed and shown herein so as to assist in distribution of gravitational forces acting on the cantilever member 30 in order for the wall mounted rack apparatus 100 to provide support for greater weight. The first end 51 of the cantilever support member 50 is operably coupled to the second wall plate member 20. The second wall plate member 20 is constructed similarly to the first wall plate member 10. It is contemplated within the scope of the present invention that the second wall plate member 20 could either be integrally formed with the first end 51 or be releasably secured thereto. As is illustrated herein, the first end 51 could be threaded onto a receiver formed on the second wall plate member 20 or employ securing pins. The illustrations herein provide exemplary techniques to secure the first end 51 and it is contemplated within the scope of the present invention that the first end 51 could be secured employing various alternate suitable techniques.

The second end 52 has formed thereon a cantilever support engagement member 60. The cantilever support engagement member 60 is operably to releasably secure to the cantilever support member 30. The cantilever support engagement member 60 includes first portion 61, second portion 62 wherein first portion 61 and second portion 62 have a void 63 therebetween. The first portion 61 and second portion 62 are formed so as to be present on opposing sides of the cantilever member 30 in order to provide releasable securing of the cantilever member 30 within void 63. This arrangement provides secure cradling of the cantilever member 30. While a preferred embodiment of the cantilever support engagement member 60 is illustrated herein, it should be understood within the scope of the present invention that the cantilever support engagement member 60 could be constructed in alternate manners in order to provide the functionality discussed herein.

The wall mounted rack apparatus 100 further includes rear support member 70. Rear support member 70 is integrally formed with cantilever support member 50 and extends upward therefrom. Rear support member 70 is manufactured from a suitable rigid material such as but not limited to metal. The rear support member 70 includes a first end 71 that can either be releasably secured to the cantilever support member 50 or integrally formed therewith. The second end 72 of the rear support member 70 is configured so as to surroundably mount to the cantilever member 30. This arrangement of the rear support member 70 provides further distribution of gravitational forces acting on an object engaged with the wall mounted rack apparatus 100 and promotes an improved ability to accommodate larger weight. It should be understood within the scope of the present invention that the second end 72 could be constructed in numerous alternate manners so as to secure to a portion of the cantilever member 30 and provide the functionality as discussed herein.

It should be understood that FIG. 1 does not represent an arrangement requirement for the wall mounted rack apparatus 100. FIG. 1 is exemplary only and it should be understood within the scope of the present invention that the wall mounted rack apparatus 100 could be employed solely or in various arrangements in order to suit a desired application.

Figure 2:
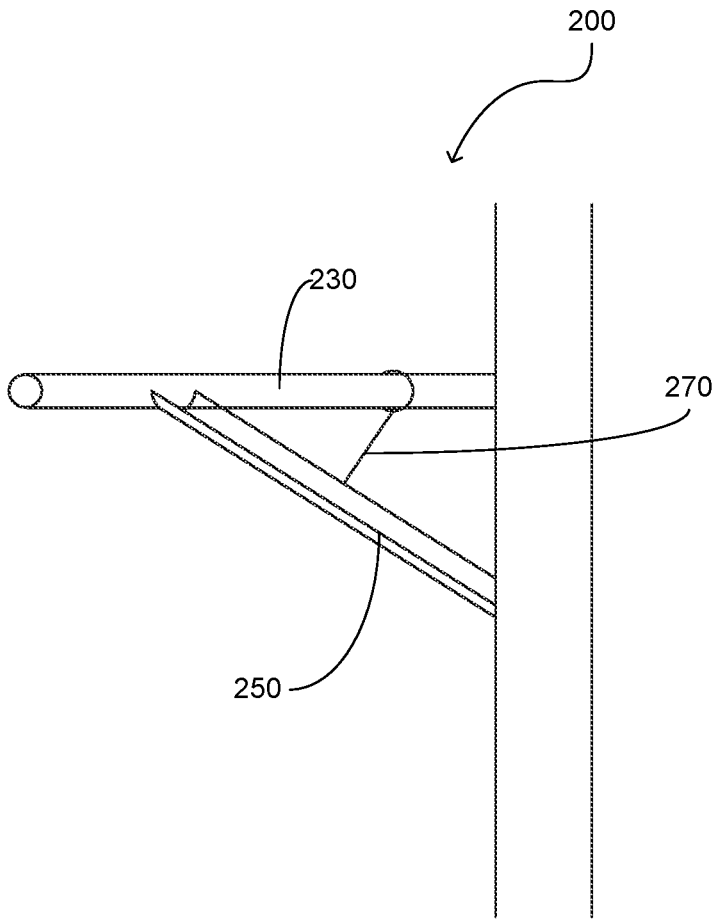
FIG. 2 is a side perspective view of a second embodiment of the present invention.

An alternate embodiment of the wall mounted rack apparatus 200 is illustrated herein in FIG. 2. The wall mounted rack apparatus 200 is substantially similar to the wall mounted rack apparatus 100 with exception of the cantilever support member 250 is U-shaped so as to provide mateable engagement with the cantilever member 230. The radius of the upper surface of the cantilever support member 250 is designed to match the circumference angle of the cantilever member 230 so as to mateably engage therewith. A rear support member 270 is present and is similar to the rear support member 70 wherein it is designed to surroundably mount the cantilever member 230. The wall mounted rack apparatus 200 would employ wall plate members(not particularly illustrated herein) or alternate elements so as to provide a suitable technique to secure the wall mounted rack apparatus 200 to a vertical wall.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A wall mounted rack apparatus configured to provide hanging of objects wherein the wall mounted rack apparatus comprises:

a cantilever member, said cantilever member having a first end and a second end, said first end being proximate a wall, said second end being distal to the wall, said cantilever member extending outward from the wall and being perpendicular thereto;

a cantilever support member, said cantilever support member having a first end and a second end, said cantilever support member being beneath said cantilever member, said first end of said cantilever support member being secured to the wall, said second end of said cantilever support member being distal to said wall and configured to couple to a portion of said cantilever member, said cantilever support member being angular in orientation between the wall and said cantilever member; and a rear support member, said rear support member having a first end and a second end, said first end of said rear support member being secured to said cantilever support member, said rear support member extending upward from said cantilever support member, said second end of said rear support member configured to operably couple to a portion of said cantilever member, wherein said second end of said cantilever support member includes a first portion and a second portion, wherein said first portion and said second portion of said second end of said cantilever support member extend upward and have a void therebetween.

2. The wall mounted rack apparatus configured to provide hanging of objects as recited in claim 1, and further including a first wall plate member, said first wall plate member being operably coupled to said first end of said cantilever member, said first wall plate member configured to be fastened to the wall.

3. The wall mounted rack apparatus configured to provide hanging of objects as recited in claim 2, wherein said second end of said rear support member is configured to surroundably mount the portion of said cantilever member.

4. The wall mounted rack apparatus configured to provide hanging of objects as recited in claim 3, and further including a second wall plate member, said second wall plate member being operably coupled to said first end of said cantilever support member, said second wall plate member configured to be secured to the wall.

5. The wall mounted rack apparatus configured to provide hanging of objects as recited in claim 4, wherein said cantilever member is telescopic.

6. A hanging apparatus configured to provide suspension of an object proximate a vertical wall wherein the hanging apparatus comprises:

a cantilever member, said cantilever member having a first end and a second end, said first end being proximate the wall, said second end being distal to the wall, said cantilever member extending outward from the wall and being perpendicular thereto, said cantilever member being operably coupled to a first wall plate member wherein the first wall plate member is secured to the wall;

a cantilever support member, said cantilever support member having a first end and a second end, said cantilever support member being beneath said cantilever member, said first end of said cantilever support member being secured to the wall, said second end of said cantilever support member being distal to said wall and configured to couple to a portion of said cantilever member, said first end of said cantilever support member having a second wall plate member coupled thereto, said second wall plate member configured to be secured to the wall, said cantilever support member being angular in orientation between the wall and said cantilever member; and a rear support member, said rear support member having a first end and a second end, said first end of said rear support member being secured to said cantilever support member, said rear support member extending upward from said cantilever support member, said second end of said rear support member configured to surroundably mount a portion of the cantilever member wherein the portion of the cantilever member surroundably mounted by the second end of the rear support member is intermediate the second end of the cantilever support member and the first wall plate member, wherein said second end of said cantilever support member includes a first portion and a second portion, wherein said first portion and said second portion of said second end of said cantilever support member extend upward and have a void therebetween, said cantilever member configured to be secured within the void.

7. The hanging apparatus configured to provide suspension of an object proximate a vertical wall as recited in claim 6, wherein the hanging apparatus is manufactured from metal.

8. The hanging apparatus configured to provide suspension of an object proximate a vertical wall as recited in claim 6, wherein said cantilever support member is U-shaped.

* * * * *